US005319671A

United States Patent [19]

Hopf

[11] Patent Number: 5,319,671

[45] Date of Patent: Jun. 7, 1994

[54] PREWARNING DEVICE FOR INDUCTION MELTING FURNACE

[75] Inventor: Manfred Hopf, Einsiedel/Thüringen, Fed. Rep. of Germany

[73] Assignee: Feuerfest Uberwachungstechnologie Saveway GmbH, Langewiesen, Fed. Rep. of Germany

[21] Appl. No.: 899,502

[22] Filed: Jun. 16, 1992

[30] Foreign Application Priority Data

Jun. 19, 1991 [DE] Fed. Rep. of Germany ..... 4120205

[51] Int. Cl.[5] ..... H05B 6/06

[52] U.S. Cl. ..... 373/145; 373/155

[58] Field of Search ..... 373/145, 139, 146, 155, 373/157, 158

[56] References Cited

U.S. PATENT DOCUMENTS

| | | | |
|---|---|---|---|
| 1,922,029 | 8/1983 | Chesnut | 373/145 |
| 4,201,882 | 5/1980 | Kolotilo et al. | 373/145 |
| 4,989,218 | 1/1991 | Tateno | 373/145 |

*Primary Examiner*—Bruce A. Reynolds
*Assistant Examiner*—Tu Hoang
*Attorney, Agent, or Firm*—Charles E. Baxley

[57] ABSTRACT

A prewarning device for an induction melting furnace serves for warning of breakouts of molten metal on ceramic furnace linings of melting furnaces. The device has electrodes that may be arranged on the furnace lining in question which are divided into two groups of different polarity and are spaced apart from each other. The electrode groups can be connected to an evaluation unit in order to determine the electrical temperature-dependent resistance of the furnace lining. In order to permit a simple application of the electrodes on the outside of the furnace lining and assure a high reliability of indication of the entire system, at least a high reliability of indication of the entire system, at least one of the electrodes is arranged as an electrode network on a first side on a ceramic foil. Either the first side of the ceramic foil or the opposite side is arranged on the furnace lining. The foil in the former case has a lower thermal conductivity and a lower electrical conductivity than the ceramic material of the furnace lining and in the latter case an approximately identical or higher thermal conductivity and an approximately identical or higher electrical conductivity.

10 Claims, 3 Drawing Sheets

PREWARNING DEVICE FOR INDUCTION MELTING FURNACE

BACKGROUND OF THE INVENTION

The present invention relates to a prewarning device for breakouts of molten metal on ceramic furnace linings of melting furnaces, particularly induction melting furnaces with electrodes or electrode networks arranged on the corresponding furnace lining, such as, in particular, on its outer side. The electrodes are divided into two groups of different polarity, spaced apart and adapted to be connected to an evaluation unit in order to determine the electrical, temperature-dependent resistance of the furnace lining between the two groups of electrodes.

In melting furnaces of this type, the ceramic furnace lining is subject to very strong thermal, chemical and mechanical stresses in operation. In this way, wash-outs and possibly cracks are formed which can extend in an induction melting furnace up to the inductor. If penetration of the molten metal into the inductor is not recognized at a sufficiently early time, the furnace can experience considerable damage and, in extreme cases, there may even be an explosive emptying of the melting unit.

In order to be able to note such defects in induction melting furnaces at an early time, prewarning means of the above type are known which utilize the principle of resistance measurement. This is based on the realization that the electrical resistance between any two contact points of the ceramic furnace lining, for instance on the outer side, is dependent on the temperature, in the manner that it decreases considerably with an increase of temperature, namely by a few powers of ten in the high-ohmic region. If a breakout point is established in the wall of the furnace lining, a local increase in temperature takes place which, with a suitable arrangement of the electrodes on the furnace lining and on its outer wall, can be noted via the resistance measurement. The problem is in being able to arrange the network of electrodes sufficiently close together on the outside of the ceramic furnace lining so as to be able to obtain a reliable early warning of the threatened breakout of the melt.

In one known prewarning device of this type for an induction melting furnace, the network of electrodes is arranged in grooves on the outside of a finish crucible which is introduced in an induction furnace as a prefabricated part and surrounded by a ceramic back-tampering material in order to fill the necessary annular slot towards the inductor wall. In this connection, the network of electrodes lies at a sufficient distance in front of the inductor wall to be able to signal in due time a threatened point of breakout without damage to the inductor. In actual practice, however, the use of finish crucibles is very limited, because a conventional furnace lining is generally preferred in which the furnace lining is built up from the ceramic material at the place of use.

With this known prewarning device, considerable difficulties exist in installing the network of electrodes for the signalling of breakout points at reasonable expense in such a manner that a reliable and accurate early recognition of a potential breakout place is possible. In the case of a conventional lining, recourse has been had to the use of bar electrodes which are arranged in vertical alignment between a heat-insulating layer and the crucible material along the circumference of the crucible, as to which see Federal Republic of Germany Patent 27 18 016-A1, in which the reduction in the electrical resistance of the at least partially sintered ceramic crucible material between the adjacent electrodes as a result of temperature increase is evaluated. The disadvantage of this known device is that there is danger of a short circuit of the inductor voltage, as well s an influencing of the measurement voltage over the vertical electrodes in the case of a wet heat-insulating layer. Also, the installation and the connection of the electrodes are difficult. This known device also has shortcomings with respect to the reliability of the indications, because the advancing molten metal is recognized relatively late.

Accordingly, it is a main important object of the present invention to provide a prewarning device of the aforementioned type which permits simple application of the electrodes on the outside of the furnace lining and assures a high dependability of indication on the part of the entire system.

SUMMARY OF THE INVENTION

The aforementioned object of the invention is achieved with a prewarning device in which at least one of the electrodes is arranged as an electrode network on one side of a ceramic foil. The ceramic foil has either the side provided with the electrode network or the opposite side arranged on the furnace lining. In the former case, the foil has a lower thermal conductivity and a lower electrical conductivity than the ceramic material of the furnace lining, while in the latter case it has approximately the same or a higher thermal conductivity, as well as approximately the same or higher electrical conductivity. In principle, it is unimportant whether only one of the electrodes of the two electrode groups or the electrodes of both groups are formed by the electrode network. The important factor is the arrangement of the electrode network on the ceramic foil.

It is essential for a prewarning device in accordance with the invention that the ceramic foil with the electrode network applied be prefabricated for the specific use and that it can be used regardless of whether the ceramic furnace lining is built up as traditional lining in the melting furnace, such as an induction melting furnace is introduced or as a finish crucible into the furnace. The ceramic foil with the integrated electrode network can easily be applied in equidistant arrangement with respect to the wall of the inductor in an induction melting furnace, in which it can also assume the task of a heat-insulating layer. As ceramic foil material, a fine, felt-like nonwoven ceramic material is preferably used, such being known per se, and the mechanical properties of which are approximately comparable to a stiff web of paper or board.

In accordance with the invention, measurement is not effected within the ceramic crucible material itself but, rather, from the outside into the ceramic material and it is therefore important that, on the one hand, when arranging the ceramic foil between the electrode network and the outside of the ceramic furnace lining, the ceramic foil material has a behavior similar to that of the furnace lining. If, on the other hand, the electrode network is arranged between the ceramic furnace lining, the thermal resistance and the electrical resistance of the foil material must be higher, and preferably much higher, than that of the furnace lining. It follows from this relationship that one particularly advantageous further feature of the invention resides in arranging the electrode network between two such ceramic foils, the one adjacent the outside of the furnace lining having approximately the same or a higher thermal conductivity than the ceramic material of the furnace lining as well as a lower specific resistance, and the one on the side away from the furnace lining having a lower thermal conductivity and a higher specific resistance. The thermal and electrical insulating properties of that ceramic foil which has the higher resistance values even make it possible to do without a separate insulating layer such as customarily provided between the inductor wall and the ceramic furnace lining.

DESCRIPTION OF THE DRAWING

The invention will be described in further detail below with reference to an embodiment shown in the drawing, in which.

DESCRIPTION OF THE INVENTION

Figure 1:
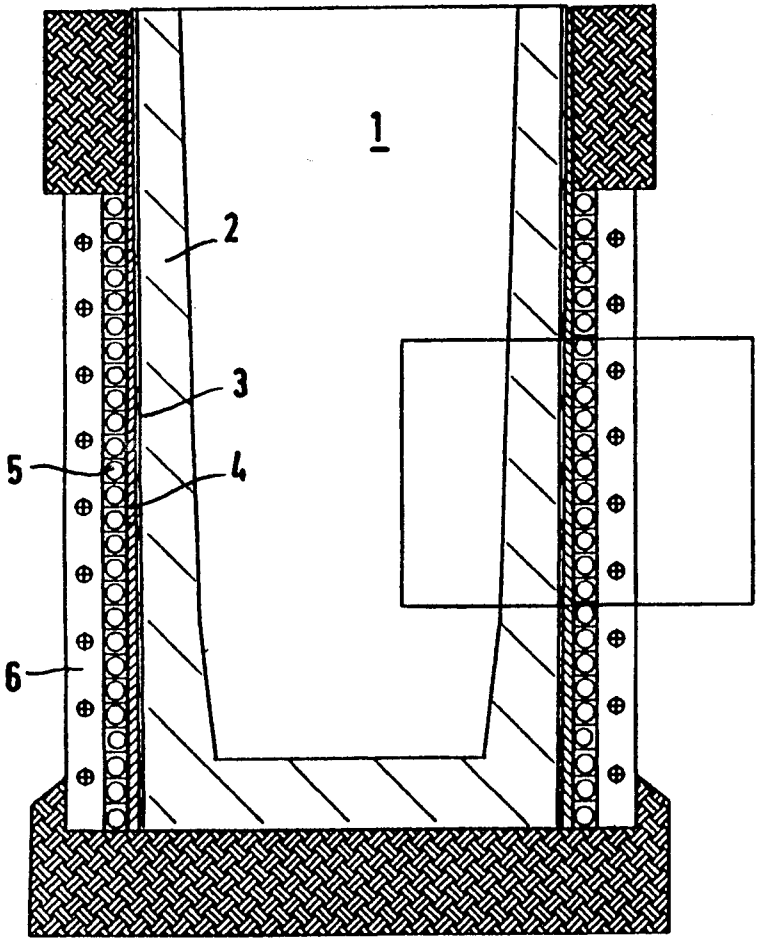
FIG. 1 is a diagrammatic longitudinal section through an induction melting furnace.

On the induction melting furnace shown in FIG. 1 there can be noted in detail a melting chamber 1 which is surrounded completely, except for an upper opening, by a furnace lining 2 which consists of a sinterable ceramic material. As FIG. 2 furthermore shows, radially adjacent the furnace lining 2 on the outside, there is an intermediate layer 3 within which an electrode network 7 is embedded, which will be explained further below. The intermediate layer 3 is further surrounded towards the outside by a coil-equalization mass 4 radially outward from which there are an induction coil 5 and a magnetic conductor 6 in the form of a yoke.

The special feature of such an induction melting furnace lies in the development of the intermediate layer 3 between the ceramic furnace lining 2 and the coil-equalization mass 4 because intermediate layer 3 both assumes a heat-insulating function and has an electrode network 7 which is part of an electrode monitoring system for the signalling in due lead time of breakouts of molten metal through the ceramic furnace lining 2. This electrode network 7 extends over the entire circumference along the outside of the ceramic furnace lining 2, as will be further explained below with reference to the developed view of FIG. 4. Intermediate layer 3 includes one or more prefabricated parts, as will be described below with reference to FIG. 3.

Figure 2:
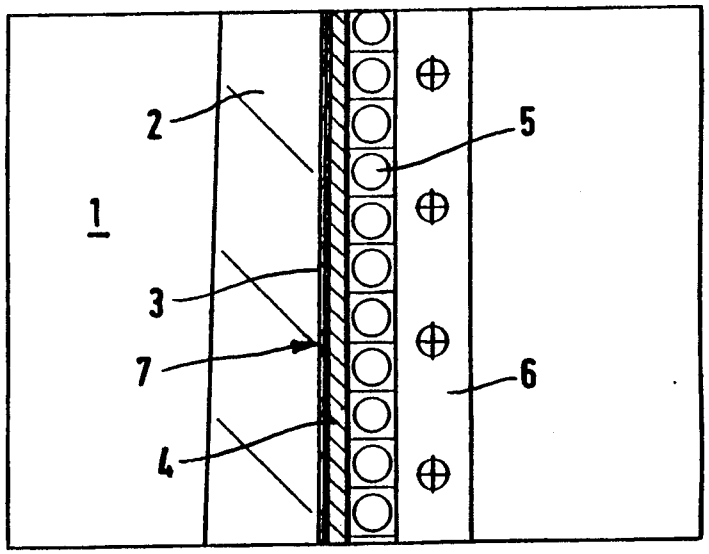
FIG. 2 is a sectional view on a larger scale through the furnace wall of the portion indicated in FIG. 1.
Figure 3:
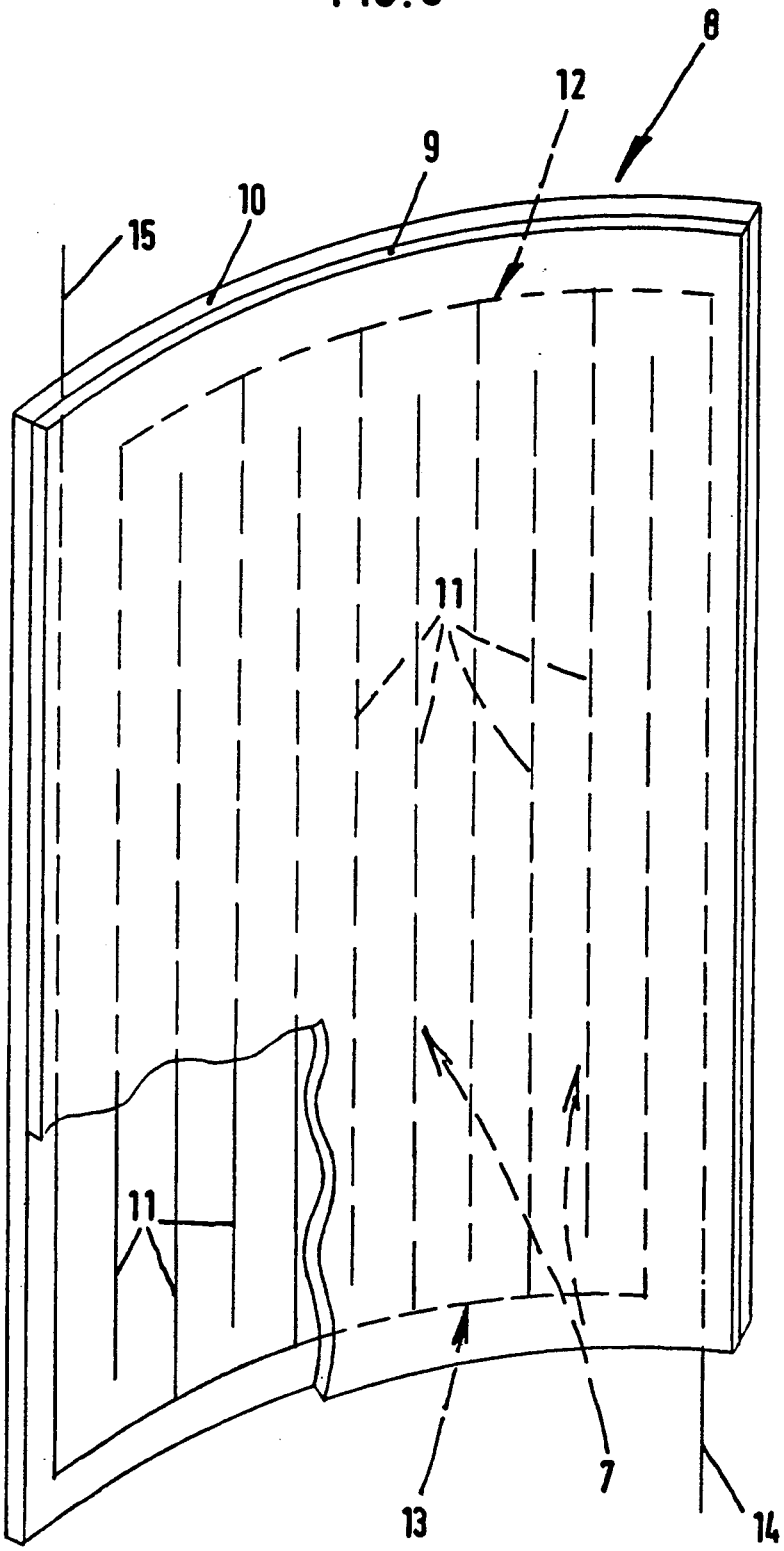
FIG. 3 is a perspective view of a prefabricated ceramic mat that is an element of a prewarning device for breakouts of molten metal in an induction melting furnace according to FIGS. 1 and 2.

Along the circumference of the furnace lining 2, the intermediate layer 3 has a plurality of prefabricated ceramic mats 8, each of which extends over the height of the furnace lining 2. One such ceramic mat 8 is shown in FIG. 3. Mat 8 is a prefabricated part which is adapted to the specific type of furnace for which it is to be used. Mat 8 has an inner foil 9 and an outer foil 10, both of which have, for instance, a felt-like ceramic fiber construction. Both foils 9 and 10 have approximately the thickness and the flexibility of cardboard and they can therefore be adapted together to the inner curvature of the furnace wall which is formed without lining by the coil-equalization mass 4 (FIGS. 1 and 2). The foils 9 and 10 can therefore also be referred to as a web of material, since they can be cut from longer webs of the ceramic material.

The electrical monitoring system is based on the principle of resistance measurement of the ceramic furnace lining 2 between two electrodes 11 (FIG. 3) some or several of which in a special configuration form the electrode network 7 which is arranged between the two ceramic foils 9 and 10. Measurement must therefore be effected from the mat 8 resting in installed position on the outside against the furnace lining 2 into the ceramic material of the furnace lining 2. Therefore, the foil 9 which rests directly on the furnace lining 2 has properties of electrical conductivity and thermal conductivity which correspond or are at least similar to those of the furnace lining 2. The outer foil 10 lying away from the furnace lining 2 in the installed position has, on the other hand, insulating properties and therefore a much lower electrical conductivity and thermal conductivity than the inner foil 9. The resistance required in each case for the foils 9 and 10 in relation to the ceramic material of the furnace lining 2 can be adjusted by suitable additions which are added to the ceramic material of the foils 9 and 10.

The electrodes 11 of the electrode network 7 consist of a material which has a high resistance to changes in temperature, a high strength at high temperature and good resistance to corrosion. For this, austenitic electrode wires are particularly suitable. The electrodes 11 are associated with a first group 12 and a second group 13, the electrodes 11 which are adjacent each other belonging to different groups 12 and 13 are being arranged at equal distances apart. Therefore, the electrodes 11 of the two groups 12 and 13 form opposite comb-like structures which interengage in the direction of the comb teeth so that in each case one electrode 11 of the one group 12 is adjacent electrodes 11 of the other group 13. This total electrode 7 is located between the two foils 9 and 10 which are connected in suitable manner to one another, whereby the electrode network 7 is fixed at the same time. Feed wires 14 and 15 are arranged on the mat 8 in suitable position, each being connected to one of the electrode groups 12 and 13 which are acted on by polarities which differ from each other.

Figure 4:
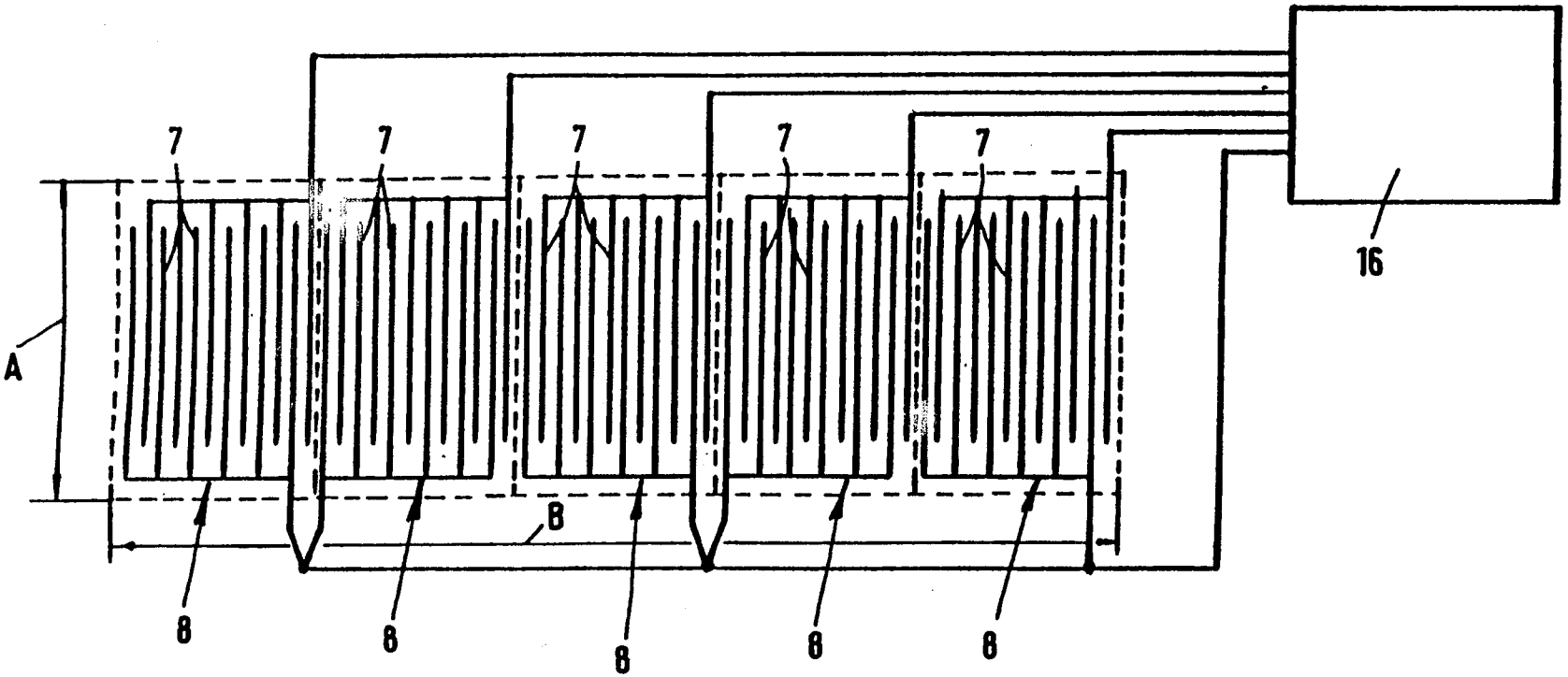
FIG. 4 is a developed view of a lining of an induction melting furnace having several mates in accordance with FIG. 3, including a showing of the connection with the corresponding electrical evaluation unit.

As shown in FIG. 4, several ceramic mats 8, for instance five of them, are arranged in circumferential direction around the furnace lining 2. In practice, the mats 8 are positioned as intermediate layer 3 (FIGS. 1 and 2), before the establishing of the furnace lining 2, along the inner wall of the inductor formed by the ceramic coating composition 4. In FIG. 4, the height of the furnace lining to be monitored, and therefore to be covered by the mats 8, is designated at A and the corresponding circumference at B. In order for breakout monitoring to be possible in part for each of the mats 8, the one wire in each case of a mat 8 is connected to a separate input of an evaluation unit 16, while the other wires of the mats 8 lie at a base potential. Each of these mats 8 forms a monitoring segment by itself, so that an incipient melt breakout along the circumference of the furnace lining can be indicated, referred to zones or segments, by the evaluation unit 16. Differing from the embodiment shown, the mats 8 can also be divided from each other in vertical direction if localization of the incipient place of danger in the vertical direction of the furnace lining is desired.

Via the evaluation unit 16, the two groups 12, 13 of the electrode network 7 (FIG. 3) are acted on by a sinusoidal alternating voltage the frequency of which is between 20 and 30 Hz. With reference to the customary power frequency of 50 Hz and the frequencies with which the inductor of an induction melting furnace is operated, this frequency range has proven to be that at which the fewest disturbances as a result of harmonics, dispersion effects and switch-over voltages occur. This frequency range depends, in addition, on the complexity of the electrical resistances which lie between the electrodes 11 of the two groups 12 and 13 of the electrode network 7 and which have a capacitive component which is caused in part by the corresponding mat 8 in which the corresponding electrode network 7 is embedded. Erroneous indications produced by a measurement DC voltage which are due to phenomena of polarization in the material of the furnace lining are avoided by the said measurement alternating voltage.

The invention well achieves the stated main object and others. The disclosed details are exemplary only and are not to be taken as limitations on the invention except as those details are included in the appended claims.

What is claimed is:

1. A warning device for detecting leakage of molten metal through a substantially ceramic lining mounted inward of a coil of an induction furnace, the device comprising electrodes mounted on a ceramic foil positioned between the lining and the coil, the electrodes arranged in two networks with each of the networks having a different polarity from the other and each of the networks connected to an evaluation unit for determining electrical temperature-dependent resistance at the lining located within the networks, at least one of the networks arranged on a side of the foil facing the lining and in intimate contact with the lining, material of the foil selected to provide it with lower thermal and electrical conductivities than of the lining.

2. A warning device for detecting leakage of molten metal through a substantially ceramic lining mounted inward of a coil of an induction furnace, the device comprising electrodes mounted on a ceramic foil positioned between the lining and the coil, the electrodes arranged in two networks with each of the networks having a different polarity from the other and each of the networks connected to an evaluation unit for determining electrical temperature-dependent resistance of the lining located within the networks, at least one of the networks arranged on a side of the foil away from the lining, material of the ceramic foil selected to provide it with higher thermal and electrical conductivities than of the lining.

3. The warning device as claimed in claim 1, with material of the foil selected to provide it with a lower specific electrical resistance than that of the lining.

4. The warning device as claimed in claim 2, with material of the foil selected to provide it with a higher specific electrical resistance than that of the lining.

5. A warning device for detecting leakage of molten metal through a substantially ceramic lining mounted inward of a coil of an induction furnace, the device comprising electrodes arranged in two networks with each of the networks having a different polarity from the other and each of the networks connected to an evaluation unit for determining electrical temperature-dependent resistance of the lining located within the networks, at least one of the networks arranged between an inner foil and an outer foil with both of the foils positioned between the lining and the coil, the inner foil maintained in intimate contact with an outer surface of the lining and made of a material having higher thermal conductivity and lower specific electrical resistance than the material of the lining, the outer foil made of a material having lower thermal conductivity and higher specific electrical resistance than the material of the lining.

6. The warning device as claimed in claim 5, wherein the inner foil and the outer foil and said at lest one of the networks are organized as a prefabricated mat ready for installation, at least one lead connected to and extending from said at least one of the networks.

7. The warning device as claimed in claim 1, with a plurality of the ceramic foils each having arranged thereon one of the electrode networks, at least one lead connecting each of the networks to the evaluation unit.

8. The warning device as claimed in claim 1, with said networks acted upon by alternating voltage.

9. The warning device as claimed in claim 1, with said networks acted upon by a sinusoidal alternating voltage with a frequency between 20 and 30 Hz.

10. A warning device for detecting leakage of molten metal through a substantially ceramic lining mounted inward of a coil of an induction furnace, the device comprising a ceramic foil positioned between the lining and the coil and provided with an outer surface facing away from the lining, electrodes arranged on said outer surface and subdivided into two networks with each of the networks having a different polarity from the other and each of the networks connected to an evaluation unit for determining electrical temperature-dependent resistance of the lining located within the networks, material of the foil selected to provide higher thermal and electrical conductivities than of the lining, the electrodes of said networks are arranged in interengaged comb shaped with equal distances from each other.

* * * * *